United States Patent [19]

Yoshizawa et al.

[11] Patent Number: 4,748,602

[45] Date of Patent: May 31, 1988

[54] ALARM MECHANISM

[75] Inventors: Keiichi Yoshizawa; Kastuya Moritaka, both of Tokyo, Japan

[73] Assignee: Seikosha Co., Ltd., Tokyo, Japan

[21] Appl. No.: 74,946

[22] Filed: Jul. 17, 1987

[30] Foreign Application Priority Data

Jul. 18, 1986 [JP] Japan ..... 61-169179

[51] Int. Cl.[4] ..... G04B 23/02

[52] U.S. Cl. ..... 368/72; 368/269

[58] Field of Search ..... 368/72–74, 368/250, 269–271, 98, 109

[56] References Cited

U.S. PATENT DOCUMENTS

| | | | |
|---|---|---|---|
| 4,452,537 | 6/1984 | Fukuda et al. | 368/74 |
| 4,460,280 | 7/1984 | Tomonori | 368/72 |
| 4,693,612 | 9/1987 | Yoshizawa | 368/74 |

*Primary Examiner*—Vit W. Miska

*Attorney, Agent, or Firm*—Bruce L. Adams; Van C. Wilks

[57] ABSTRACT

An alarm mechanism for an alarm clock has an alarm hand and an hour hand mounted coaxially with respect to each other and the alarm hand and the hour hand are formed with integral hubs having cam grooves and cam pawls. The cam grooves and cam pawls are positioned with the same positional relationship with respect to the hub portions of the alarm hand and the hour hand so that at a preselected alarm time, the cam grooves and cam pawls cooperatingly engage one another to thereby actuate a mechanism to sound the alarm of the alarm clock. The alarm hand has an alarm pinion gear formed integrally with the annular hub portion of the alarm hand. Thus, in attaching the hands to the clock during assembly, it is possible to attach the alarm hand and the hour hand at any random angular position without having to pay special attention to the respective positional relationships of the two hands.

7 Claims, 3 Drawing Sheets

ALARM MECHANISM

BACKGROUND OF THE INVENTION

1. Field of the Invention

The present invention relates to an alarm mechanism of an alarm clock.

2. Description of the Prior Art

A conventional alarm mechanism is arranged as follows: cam grooves are formed in one of an hour hand wheel gear and an alarm wheel gear that are located coaxially with each other, and cam pawls are formed on the other. When reached at the alarm set time, the cam pawls are fitted into the cam grooves by means of a spring force of an urging spring, thereby closing an alarm switch to detect the set time of an alarm. An alarm hand is force-fit into the distal end of the pipe portion of the alarm wheel gear, and a hour hand is force-fit to the distal end of the pipe portion of the hour wheel gear.

In such an alarm mechanism, when installing the pointers, it has been necessary to fit the cam grooves and the cam pawls to each other by operating a hand rotating knob, respectively force-fit the alarm hand and the hour hand into the pipe portion of the alarm wheel gear and the pipe portion of the hour hand wheel gear in a predetermined positional relationship by maintaining that state, and subsequently further adjust the positional relationship between the alarm hand and the hour hand by effecting a hand rotating operation. Since this adjustment work involves, for instance, the refitting of the hour hand, the adjustment work is very complicated and consumes time, so that it has been a large hindrance to the assembly process of clocks under the present situation.

In U.S. Pat. No. 4,693,612, one of the present applicants has earlier proposed an alarm mechanism which is capable of facilitating and simplifying the adjustment work remarkably and whose alarm accuracy is high. In this earlier invention, the arrangement is such that the cam grooves are formed in one of two skirt portions which abut against the alarm hand and the hour hand, while the cam pawls are formed in the other, and the cam grooves and the cam pawls are fitted to each other when these members in the skirt portions are opposed to each other, thereby detecting the alarm time.

Even in this improved earlier invention, the alarm hand and the hour hand are both fitted into the respective pipe portions in their skirt portions, and the cam pawls slides on the surface of the skirt portion. Therefore, the force-fitting of the alarm hand-side skirt portion and the pipe portion, must be firmly effected so as not to be interlinked with the rotation of the hour hand. For this reason, there are drawbacks in that there is a possibility of a crack occurring in the skirt portion, and that the work of force-fitting the alarm hand is required. Thus there has still been room for improvement.

SUMMARY OF THE INVENTION

Accordingly, an object of the present invention is to effect improvement of the efficiency of assembling the alarm mechanism and to reduce the number of parts, thereby overcoming the drawbacks of the prior art.

To this end, according to the present invention, there is provided an alarm mechanism comprising: an alarm hand and an hour hand that are provided coaxially, each having an annular portion and a pointer portion formed integrally with the annular portion; cam grooves formed in one of the mutually opposed portions of the annular portions and cam pawls formed in the other to fit into the cam grooves; and an alarm pinion formed integrally with a rear-end portion of the annular portion of the alarm hand.

BRIEF DESCRIPTION OF THE DRAWINGS

Other features and advantages of the invention will be apparent from the following description referring to the accompanying drawings, in which.

DESCRIPTION OF THE PREFERRED EMBODIMENT

Referring now to the accompanying drawings, a preferred embodiment according to the present invention will be described hereunder.

Figure 1:
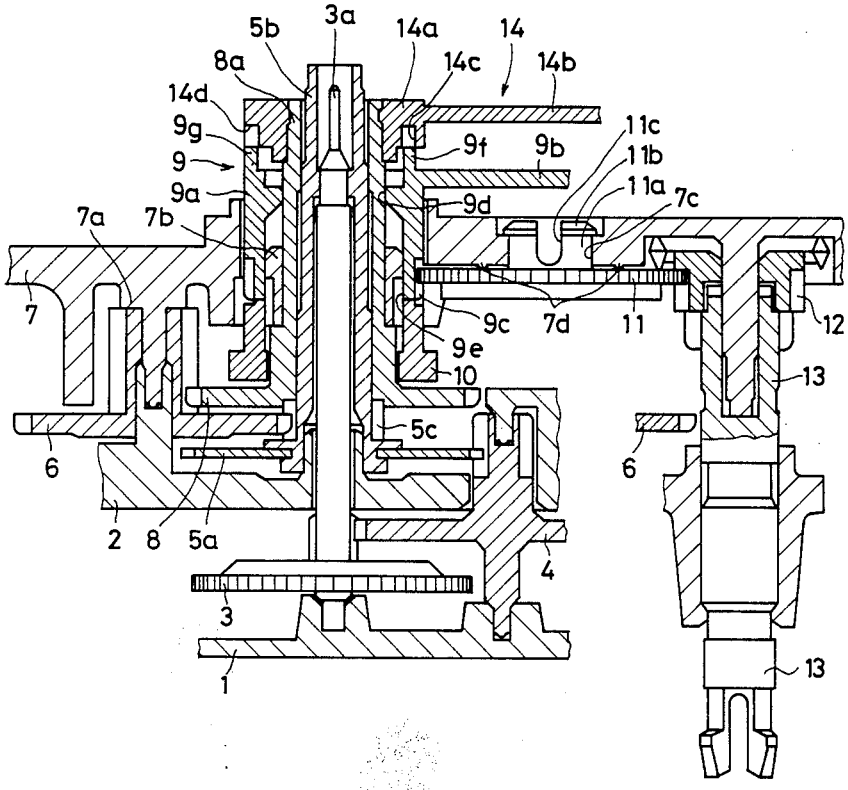
FIG. 1 is a cross-sectional view of a preferred embodiment of the invention.

As shown in FIG. 1, a second hand wheel 3 to which the rotational force of a driving source is transmitted is provided between an upper plate 1 and an intermediate plate 2. The rotational force of this second hand wheel rotates a minute hand wheel 5*a* via an intermediate wheel 4. The minute hand wheel 5*a* and a minute wheel pipe 5*b* are coupled with each other via a slip mechanism (not shown). Furthermore, a transmission wheel 6 is rotatably pivotally supported by a support column 7*a* formed integrally with a lower plate 7. This transmission wheel 6 meshes with a pinion 5*c* of the minute hand pipe 5*b* and also meshes with an hour wheel gear 8 so as to transmit the rotation of this minute hand pipe 5*b*. The minute hand pipe 5*b* is fitted coaxially with an axial portion 3*a* of the second hand wheel 3, and an hour hand pipe 8*a* of an hour hand wheel 8 is fitted with the outer periphery of the minute hand pipe 5*b*. The upper portion of a stepped portion of the outer peripheral surface the hour hand pipe 8*a* is fitted with a pipe portion 7*b* provided to the lower plate 7, whereby the hour hand wheel 8 is restricted from moving upwardly in FIG. 1 to effect its positioning, and the hour hand pipe 8*a* is maintained in a vertical state.

Figure 2:
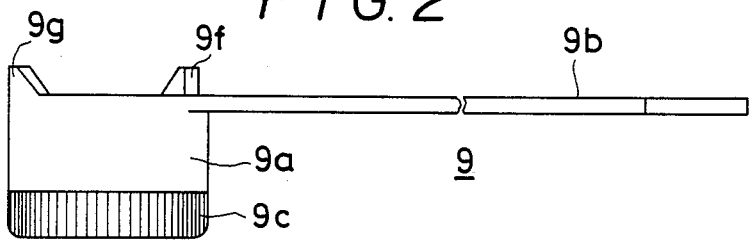
FIG. 2 is an enlarged front elevational view of an alarm hand.
Figure 3:
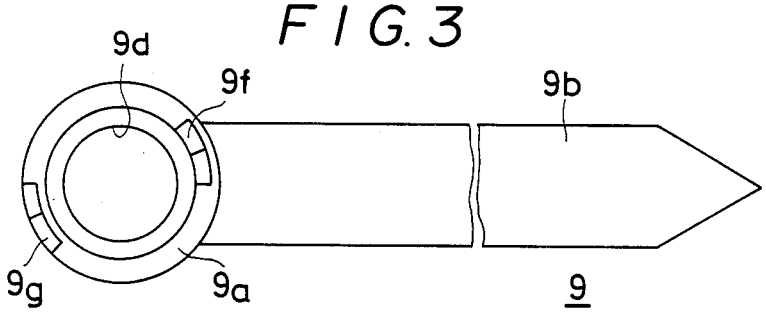
FIG. 3 is a top plan view thereof.

An annular or hub portion 9*a* of an alarm hand 9 shown in FIGS. 2 and 3 is coaxially rotatably fitted with the outer periphery of the hour hand pipe 8*a*. The alarm hand 9 is arranged such that a pointer portion 9*b* is formed integrally at one end portion (an upper end portion) of the annular portion 9*a*, and an alarm pinion 9*c* is formed integrally at the outer peripheral portion of the other end portion of the annular portion 9*a*. An inner peripheral surface 9*d* of the annular portion 9*a* is fitted rotatably and slidably with the outer peripheral surface of the hour hand pipe 8*a*, while an inner peripheral surface 9*e* on the side of the alarm pinion 9*c* is fitted rotatably and slidably with the outer peripheral surface of the pipe portion 7*b* which is integral with the lower plate 7. A portion of a lifting lever 10 urged by an urging spring (not shown) is brought into contact with the annular portion 9a, i.e., the rear-end surface of the alarm hand 9, and the annular portion 9a is thereby urged outwardly (upwardly in FIG. 1) of the lower plate 7.

An alarm transmission wheel 11 meshes with the alarm pinion 9c. An axial portion 11a having a collar 11b at its distal end is provided at the alarm transmission wheel 11, and this axial portion is provided with a split groove 11c. The axial portion 11a snap fits with a through hole 7c provided in the lower plate 7, and the alarm transmission wheel is thereby supported by the lower plate 7 such as to be undetachable and rotatable. A projection 7d disposed adjacent to the alarm transmission wheel 11 such as to oppose the same is provided on the lower plate 7, and the alarm transmission wheel 11 rotates while frictionally sliding on this projection 7d. The alarm transmission wheel 11 meshes with an alarm setting pinion 12, which is rotated unidirectionally by the rotation of a hand rotating shaft 13.

Figure 4:
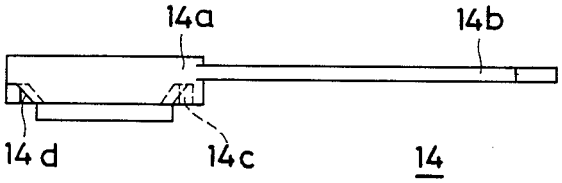
FIG. 4 is an enlarged front elevational view of an hour hand.
Figure 5:
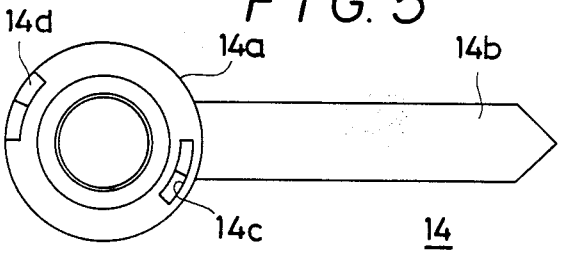
FIG. 5 is a bottom view thereof.

As shown in FIGS. 4 and 5, an hour hand 14 has an annular or hub portion 14a force-fit with the distal end of the hour hand pipe 8a as well as a pointer portion 14b formed integrally therewith. With respect to the opposing portions of the annular portion 9a of the alarm hand 9 and the annular portion 14a of the hour hand 14, cam pawls 9f, 9g project from the upper surface of the annular portion 9a, as shown in FIGS. 2 and 3, while cam grooves 14c, 14d are provided on the lower surface of the annular portion 14a, as shown in FIGS. 4 and 5. The cam pawls 9f, 9g and the cam grooves 14c, 14d are respectively formed at different diameters from the axial centers, and in this example the front surface of the advancing direction of the hour hand is formed on a vertical surface. In addition, the cam pawls 9f, 9g and the cam grooves 14c, 14d are fitted to each other simultaneously in a face-to-face relationship and in a positional relationship in which the pointer portions 9b and 14b are superposed on each other.

In assembly, after the parts excluding the alarm hand 9 are first assembled on the upper plate 1, the intermediate plate 2, and the lower plate 7, the alarm hand 9 is assembled last. In other words, the annular portion 9a is fitted around the outer peripheral portion of the hour hand pipe 8a from the outside of the lower plate 7 with the side of the alarm pinion 9c facing inwardly. The inner peripheral surface 9e on the side of the alarm pinion 9c is fitted to the outer periphery of the pipe portion 7b, and the alarm pinion 9c meshes with the alarm transmission wheel 11. Subsequently, the hour hand 14 is force-fit into the hour hand pipe 8a. In other words, the annular portion 14a with which the pointer portion 14b has been formed integrally is force-fit into the hour hand pipe 8a. This completes the assembly. The hour hand 14 can be installed without special need to pay attention to the direction of the pointer portion 14b, and the minute hand (not shown) is positioned and installed in its relationship with the pointer portion 14b of the hour hand 14, and the second hand (not shown) is fitted to a second hand axis 3a.

Figure 6A:
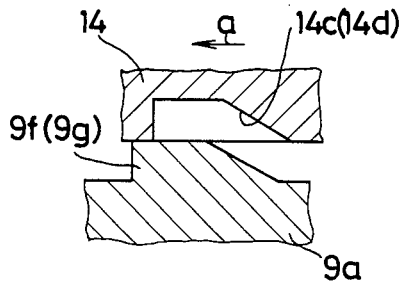
FIGS. 6A–6C are explanatory view illustrating the operation of fitting of cam grooves and cam pawls in annular portions of the hour hand and the alarm hand, respectively.
Figure 6B:
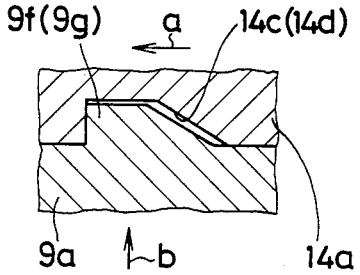
Figure 6C:
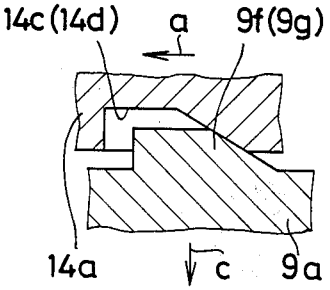

When the time approaches the alarm set time, the cam grooves 14c, 14d move in the direction of the arrow 'a' from the state shown in FIG. 6A to that shown in FIG. 6B and face the cam pawls 9f, 9g. Since the annular portion 9a of the alarm hand 9 had than been pushed by the lifting lever 10 and urged in the direction of the arrow 'b', the cam pawls 9f, 9g are respectively fitted into the cam grooves 14c, 14d and the alarm switch (not shown) is thereby closed. Subsequently, with an elapse of time, the cam pawls 9f, 9g and the cam grooves 14c, 14d slide on their respective inclined surfaces, as shown in FIG. 6C, and the annular portion 9a is displaced in the direction of the arrow 'c' in opposition to the resilience of the lifting lever 10, thereby opening the alarm switch.

Incidentally, when setting the alarm time, the alarm setting pinion 12 is rotated by rotating the hand rotating shaft 13 in a predetermined direction. Since this rotation is transmitted to the alarm pinion 9c via the alarm transmission wheel 11, the alarm hand 9 rotates and a desired alarm time is set. Since the slip torque of the alarm transmission wheel 11 in relation to the lower plate 7 is set to a predetermined magnitude owing to such factors as the distance between the through hole 7c and the axial portion 11a, the length of the axial portion 11a, and the height of the projection 7d, the annular portion 9 will not rotate by following the rotation of the hour hand pointer 14a. In other words, the alarm transmission wheel 11 also plays the role of retaining the alarm hand 9 in a desired position.

The present invention has the above-described arrangement, and since the alarm hand is arranged such that the pointer portion and the alarm pinion are formed integrally with the annular portion, the number of pieces reduced, and can be used, the work of force-fitting of the alarm hand can be eliminated, so that the control of fitting the dimensions between the skirt portion of the alarm hand and the pipe portion of the alarm wheel becomes unnecessary. Hence, the effect in production and assembly is remarkable. In addition, the structure is simple, a reduction in costs can be attained, and the alarm accuracy can be enhanced.

What is claimed is:

1. An alarm mechanism comprising:

an alarm hand and an hour hand arranged coaxially with each other, each hand having an annular portion and a pointer portion formed integrally with its respective annular portion, said annular portions having mutually opposed facing surfaces;

cam grooves formed in one of the mutually opposed facing surfaces of said annular portions, and cam pawls formed on the other facing surface to fit into said cam grooves; and an alarm pinion formed integrally with a read-end portion of said annular portion of said alarm hand.

2. An alarm mechanism for an alarm clock comprising:

an alarm hand and an hour hand rotatably mounted coaxially with respect to each other, said hands having respective hub portions integrally formed therewith into a one-piece structure, said hub portions slidably contacting one another;

one of said hands having thereon multiple indented cam means and the other of said hands having thereon a like number of multiple projecting cam means, individual ones of said cam means on each of the respective hands being at different radial distances from their respective hub axes, all of said indented cam means and said projecting cam means cooperatingly engaging one another at a preselected alarm time to effect the sounding of an alarm; and an alarm pinion formed integrally with a rear-end portion of said annular portion of said alarm hand.

3. An alarm mechanism according to claim 2, and including means for resiliently urging said alarm hand against said hour hand.

4. An alarm mechanism for an alarm clock comprising:

an alarm hand and an hour hand mounted coaxially with respect to each other and being rotatable about a given axis, said hands having respective hub portions integrally formed therewith and having opposed faces in slidable contact with one another;

multiple cam pawls projecting from the face of one of said hands on diametrically opposite sides of and at different radial distances from said axis;

multiple cam grooves extending inwardly from the face of the other of said hands on diametrically opposite sides of and at different radial distances from said axis, the cam grooves being configured to receive therein respective ones of the cam pawls when said hour hand rotates to a predetermined position relative to said alarm hand; and, an alarm pinion formed integrally with one of said hubs.

5. An alarm mechanism according to claim 4, and including means for sounding an alarm when said hour hand rotates to said predetermined position.

6. An alarm mechanism according to claim 4, wherein the cam pawls are formed on the hub portion of the alarm hand.

7. An alarm mechanism according to claim 4, wherein a front surface of the cam pawls with respect to the direction of advancement of the alarm hand is slanted and cooperates with a corresponding slanted surface of said cam grooves to effect the sound of an alarm at a preselected alarm time.

* * * * *